United States Patent [19]

Kawasaki et al.

[11] Patent Number: 4,990,390

[45] Date of Patent: Feb. 5, 1991

[54] FIBER GRID REINFORCEMENT

[75] Inventors: Hirotaka Kawasaki; Takanori Hirai; Takuro Odawara; Kimitoshi Ryokai; Osamu Furukawa; Masayoshi Sato; Teruyuki Nakatsuji; Minoru Sugita, all of Tokyo; Kenichi Sekine, Sagamihara, all of Japan

[73] Assignees: Shimizu Construction Co., Ltd., Tokyo; Dainihon Glass Industry Co., Ltd., Sagamihara, both of Japan

[21] Appl. No.: 448,950

[22] Filed: Dec. 12, 1989

[30] Foreign Application Priority Data

| | | | |
|---|---|---|---|
| Dec. 15, 1988 | [JP] | Japan | 63-317081 |
| Jul. 21, 1989 | [JP] | Japan | 1-189737 |
| Aug. 9, 1989 | [JP] | Japan | 1-206122 |

[51] Int. Cl.[5] ..... B32B 5/12

[52] U.S. Cl. ..... 428/113; 428/105; 428/408; 428/902

[58] Field of Search ..... 428/105, 113, 408, 402

[56] References Cited

U.S. PATENT DOCUMENTS

| | | | |
|---|---|---|---|
| 2,274,468 | 2/1942 | Bell | 52/177 |
| 3,755,054 | 8/1973 | Medney | 156/181 |
| 4,706,430 | 11/1987 | Sugita et al. | 52/309.16 |
| 4,819,395 | 4/1989 | Sugita et al. | 52/309.16 |

*Primary Examiner*—James J. Bell

*Attorney, Agent, or Firm*—Oblon, Spivak, McClelland, Maier & Neustadt

[57] ABSTRACT

A fiber grid reinforcement is of a flat shape and has first and second directions perpendicular to each other. The fiber grid reinforcement includes a plurality of first fiber bundles, a plurality of second fiber bundles, and a resin material. The first fiber bundles are generally disposed along the first direction and generally parallel to one another. Each of the first fiber bundles includes at least one first group of fibers. The second fiber bundles are generally disposed along the second direction and generally parallel to one another. Each of the second fiber bundles inbcludes at least one second group of fibers. The second fiber bundles intersect perpendicular to the first fiber bundles at intersecting sections so as to form a grid structure. The first group and the second group of fibers are layered alternately at the intersecting sections in such a manner that at least one outermost layer is the second group. The resin material bonds fibers in each group, and bonds the groups to one another. Each of the first group has a plurality of fibers, the fibers being generally arranged along the first direction. Each of the second group has a plurality of fibers, the fibers being generally arranged along the second direction. Each of the second fiber bundles includes a greater number of fibers than each of the first fiber bundles. Accordingly, the fiber grid reinforcement has a greater flexibility in the first direction than in the second direction.

6 Claims, 17 Drawing Sheets

FIBER GRID REINFORCEMENT

BACKGROUND OF THE INVENTION

The present invention relates to a fiber grid reinforcement. More specifically, the invention concerns a fiber grid reinforcement which has a greater flexibility and tensile strength in one direction.

Prior Art

U.S. Pat. No. 4,819,395 discloses a reinforcing unit of a textile grid structure which is employed in a concrete construction or a plastic boat. This reinforcing unit is relatively thick so as to lack flexibility.

Consequently, this reinforcing unit is sometimes disadvantageous. For example, if the reinforcing unit is bent and wrapped around a part of a piled earth structure and is embedded in the piled earth, roll-compaction force is not evenly distributed through the piled earth. The piled earth is not therefore sufficiently compacted; and the upper surface of the piled earth is not able to be compacted to a level surface. Furthermore, the reinforcing unit is susceptible to cracking or breakage by tensile force along one direction since the reinforcing unit does not have any virtue for such a tensile force.

SUMMARY OF THE INVENTION

It is therefore an object of the present invention to provide a fiber grid reinforcement having a greater flexibility in one direction than in the other direction.

It is another object of the present invention to provide a fiber grid reinforcement in which tensile strength and shearing strength vary depending on the direction in the fiber grid reinforcement.

In accordance with one aspect of the present invention, the fiber grid reinforcement is of a flat shape and has first and second directions perpendicular to each other. The fiber grid reinforcement includes a plurality of first fiber bundles, a plurality of second fiber bundles, and a resin material. The first fiber bundles are generally disposed along the first direction and generally parallel to one another. Each of the first fiber bundles includes at least one first group of fibers. The second fiber bundles are generally disposed along the second direction and generally parallel to one another. Each of the second fiber bundles includes at least one second group of fibers. The second fiber bundles intersect perpendicularly to the first fiber bundles at intersecting sections so as to form a grid structure. The first group and the second group of fibers are layered alternately at the intersecting sections in such a manner that at least one outermost layer is the second group. The resin material bonds fibers in each group, and bonds the groups to one another. Each of the first group has a plurality of fibers which are generally arranged along the first direction. Each of the second group has a plurality of fibers which are generally arranged along the second direction. Each of the second fiber bundles includes a greater number of fibers than each of the first fiber bundles.

Accordingly, the fiber grid reinforcement has greater flexibility in the first direction than in the second direction. It is preferable for embedding in piled earth. It therefore allows the piled earth to be stable, of greater height and of steeper slope than in the prior art.

The strength values of the fiber grid reinforcement vary depending on the direction therein. That is, the local shearing strength of the second fiber bundles is improved since each of the second fiber bundles has more fibers than each of the first fiber bundles. Accordingly, the entire tensile strength along the first fiber bundles is greatly improved.

BRIEF DESCRIPTION OF THE DRAWINGS

FIG. 6 is a side view of the completed piled earth.

DETAILED DESCRIPTION OF THE PREFERRED EMBODIMENTS

With reference to the accompanying drawings, various preferred embodiments of the present invention will be described in detail hereinafter.

First Embodiment

Figure 18:
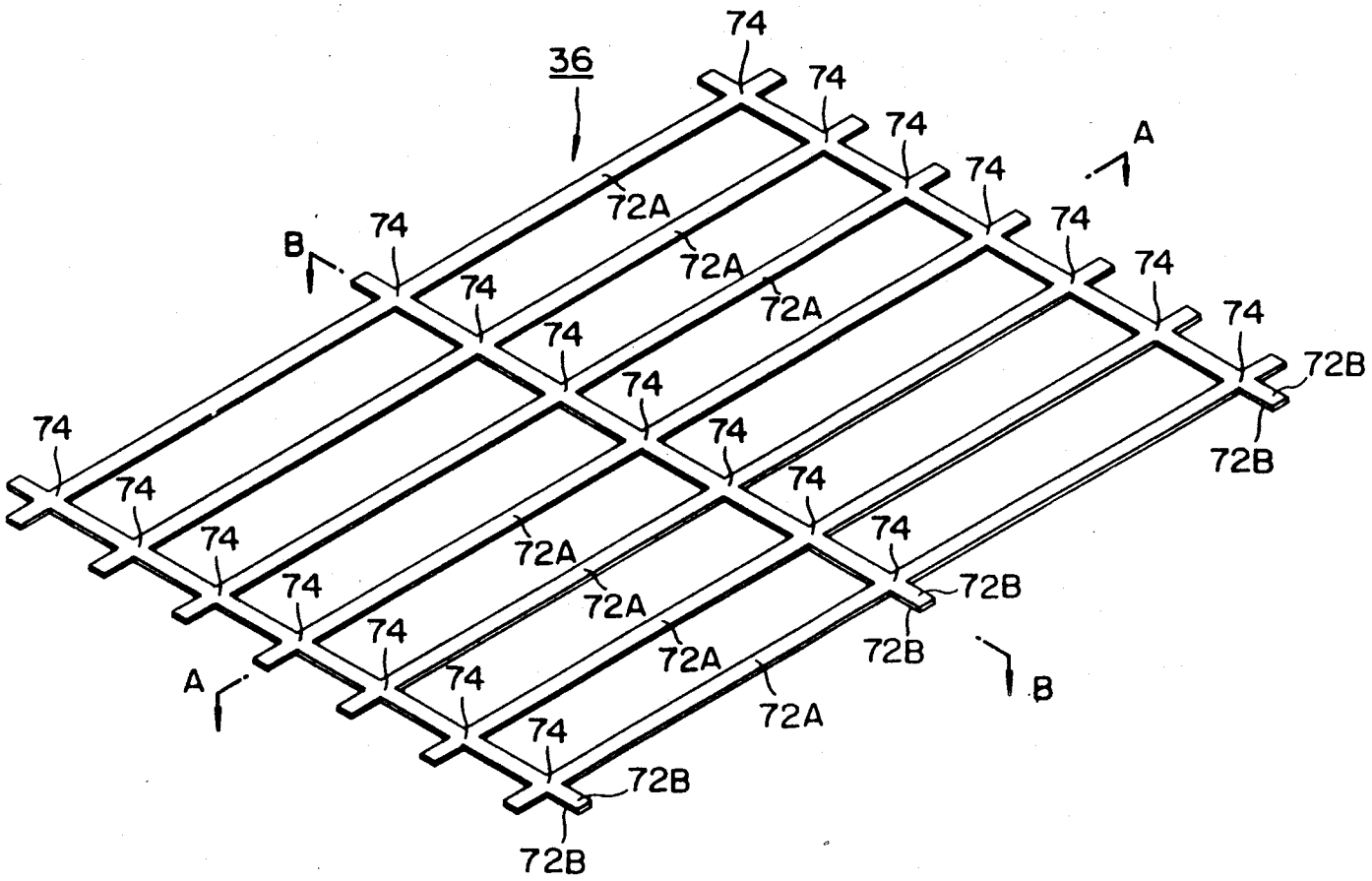
FIG. 18 is a perspective view of a fiber grid reinforcement according to a first embodiment of the present invention.

FIG. 18 depicts a fiber grid 36 in accordance with a first embodiment of the present invention. The fiber grid 36 comprises a plurality of first bundles 72A and a plurality of second bundles 72B which are disposed in a plane. The first bundles 72A intersect perpendicularly to the second bundles 72B so as to form a grid structure. The fibers 72 in the bundles 72A and 72B are bonded with resin 73. The first bundles 72A are equally spaced and disposed parallel to one another. The second bundles 72B are equally spaced and disposed parallel to one another, but are farther apart than the first bundles 72A. As will be described later, the fiber grid 36 therefore has great flexibility and mechanical strength.

Figure 19:
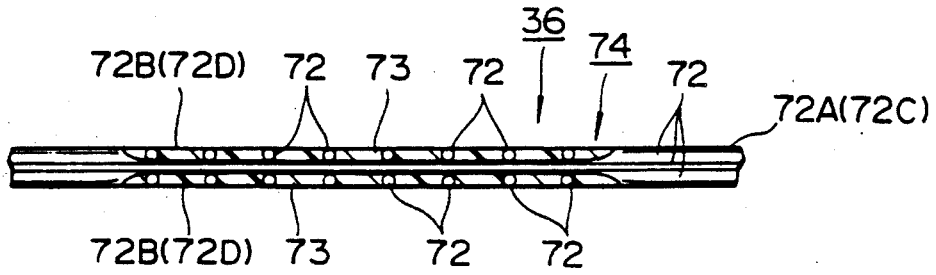
FIG. 19 is a side cross sectional view of the fiber grid reinforcement along line A—A in FIG. 18.
Figure 20:
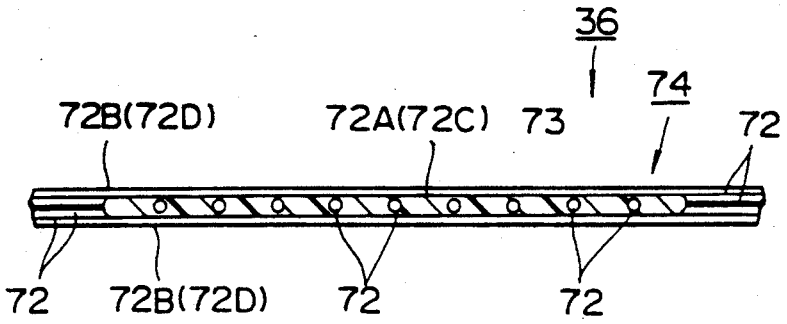
FIG. 20 is a side cross sectional view of the fiber grid reinforcement along line B—B in FIG. 18.

The intersecting section 74, where the first bundle 72A and the second bundle 72B intersect, is illustrated in FIGS. 19 and 20. Each of the first bundles 72A comprises a first fiber group 72C. Each of the second bundles 72B comprises two second fiber groups 72D which are arranged in rows. In the intersecting section 74, the first group 72C is intermediated between a pair of the second groups 72D.

Each of the first fiber groups 72C comprises a number of fibers 72 which are arranged in parallel along the lengthwise direction of the first fiber bundles 72A. Each of the fiber groups 72D comprises generally the same number of fibers 72 which are arranged in parallel along the lengthwise direction of the second fiber bundles 72B. Accordingly, each of the second fiber bundles 72B includes approximately twice as many fibers 72 as in the first fiber bundles 72A, so that the fiber grid reinforcement 36 has greater flexibility in the lengthwise direction of the first bundles 72A than the lengthwise direction of the second fiber bundles 72B.

The intersecting section 74 is pressed to a final form shown in FIGS. 19 and 20 so that the bulge at the intersecting section 74 caused by the layering of three groups 72D, 72C, and 72D is compacted to the same thickness as the other sections of the fiber grid 36. The thickness of the fiber grid 36 is preferably less than 2 mm so that the fiber grid may be sufficiently flexible. More preferably, the thickness is less than 1 mm. Additionally, the first fiber bundles 72A have a generally uniform width; and the second fiber bundles 72B have a generally uniform width greater than that of the first fiber bundles 72A in order that the fiber gird 36 has greater flexibility along the lengthwise direction of the first bundles 72A.

The material of the fibers 72 is selected from glass fiber, carbon fiber, aramid fiber, polyester fiber, nylon fiber, organic fiber, ceramic fiber such as those made of alumina, or metallic fiber such as stainless steel fiber. Alternatively, the above materials may be combined at suitable proportions. Preferably, glass fiber and carbon fiber are used due to their relatively light weights and high strengths.

The resin 73, which bonds the fibers 72, is preferably selected from the following due to characteristics of the fiber: vinyl ester resin, unsaturated polyester resin, epoxy resin, phenol resin, and so on.

The ratio of the fiber 72 and the resin 73 is defined according to the features of the fiber 72 and the intended use of the fiber grid 36. For example, if the fiber 72 is glass fiber and the resin 73 is vinyl ester resin, the fiber 72 is preferably 30 to 70% of the total volume. If the fiber 72 is carbon fiber primarily made from a pitch carbon and the resin 73 is vinyl ester resin, the fiber 72 is preferably 20 to 60% of the total volume. If the ratio of the fiber 72 is less than the above level, the mechanical strength of the fiber grid 36 is remarkably low. If the ratio of the fiber 72 is much greater, the fiber grid 36 is difficult to form.

At least one of the outermost layers should be the second fiber groups 72D to prevent the fiber groups 72C and 72D of the fiber grid 36 from separating, since the fiber grid 37 may be bent in a direction along the first fiber bundle 72A. It is more preferable that both outermost layers are the second fiber bundles 72D. If both outermost layers are the first fiber groups 72C, separation may occur because of differences in curvature between the first fiber groups 72C during bending, in addition to the outward force produced by the soil component.

The fiber grid reinforcement 36 can be utilized in piled earth because of the great flexibility along one direction and the great mechanical strength resulting from the shape thereof. The fiber grid reinforcement 36 is embedded in a soil component of the piled earth in such a manner that one or more parts of the fiber grid 36 are bent along the lengthwise direction of the first fiber bundles 72A and the other parts are kept in flat. Alternatively, the fiber grid 36 is kept flat in the soil component. In any event, the fiber grid 36 is preferably disposed in such a manner that the lengthwise direction of the first bundles 72A are along a direction through which a force may act on the fiber grid 36. Examples of this usage will be described later with reference to FIGS. 1 through 17.

Since the fiber grid 36 is pressed (especially the intersecting sections 74), and since at least one outermost layer is the second fiber groups 72D, the strength and durability of the intersecting section 74 are highly improved. In other words, the fiber grid 36 resists forces which may contribute to the separation of the layers from one another.

Furthermore, since the fiber grid 36, especially the intersecting sections 74, are pressed to the same thickness as the other parts, the thickness of the grid 36 is reduced. Therefore, when the fiber grid 36 is embedded in piled earth, the fiber gird 36 is tightly held in the soil component of the piled earth.

The first fiber bundles 72A have fewer fibers than the second fiber bundles 72B. The intervals between the second bundles 72B is larger than that of the first bundles 72A, so that each of the first fiber bundles 72A, in a unit length, has fewer intersecting sections 74 than the second fiber bundles 72B. Accordingly, the fiber grid 36 has greater flexibility in a direction parallel to the first bundles 72A than in a direction parallel to the second bundles 72B.

Consequently, the fiber grid 36 can be easily bent in the direction along the first bundles 72A so that the fiber grid 36 is prevented from breakage when the fiber grid 36 is embedded in the piled earth 36 and is roll-compacted. The fiber grid 36 remains in the soil component unitarily so that the piled earth can receive suitable, uniform, evenly-distributed force resulting from roll-compaction operation.

The interval of the first bundles 72A is smaller than that of the second bundles 72B, so that the second fiber bundles 72B receive little shearing stress and little bending strength if a force acts along the lengthwise direction of the first bundles 72A. In addition, the second fiber bundles 72B have fibers more than the first fiber bundles 72A and have a greater width than the first fiber bundles 72A, so that the shearing and bending strength of the second fiber bundles 72B is improved. Therefore, the entire fiber grid 36 has great tensile strength in the lengthwise direction of the first fiber bundles 72A.

The proportion of the interval of the second bundles 72B to the interval of the first bundles 72A are determined by the intended use of the fiber grid reinforcement 36.

If the tensile force along the lengthwise direction of the first bundles 72A is relatively great, it is preferable that the interval of the second fiber bundles 72B is much greater than that of the first fiber bundles 72A. For example, if the fiber grid 36 is embedded horizontally in soil component of high fluidity, such as sand, settling of the soil component will bend the fiber grid 36 and thus will generate relatively great tensile force along the lengthwise direction of the first bundles 72A. Sand will be contained in the rectangular openings of the fiber grid 36. The fiber grid 36 will be held in place by friction. The second fiber bundles 72B can resist local shearing or bending force caused by the tensile force since the interval of the first fiber bundles is very small.

On the other hand, if the tensile force along the lengthwise direction of the first bundles 72A is relatively small, it is necessary that the interval of the second fiber bundles 72B be greater than that of the first fiber bundles 72A. However, the interval of the second fiber bundles 72B is not necessarily so great in comparison with the above case wherein the tensile force is great. For example, if the fiber grid 36 is embedded in a soil component of low fluidity, in other words, the soil component is stable, the great tensile force will not occur. In this case, the soil component holds the fiber grid 36 more tightly by a cohesive power of clay since the number of the second fiber bundles 72B per unit area is increased; the second fiber bundles are wider than the first fiber bundles 72A.

Figure 21:
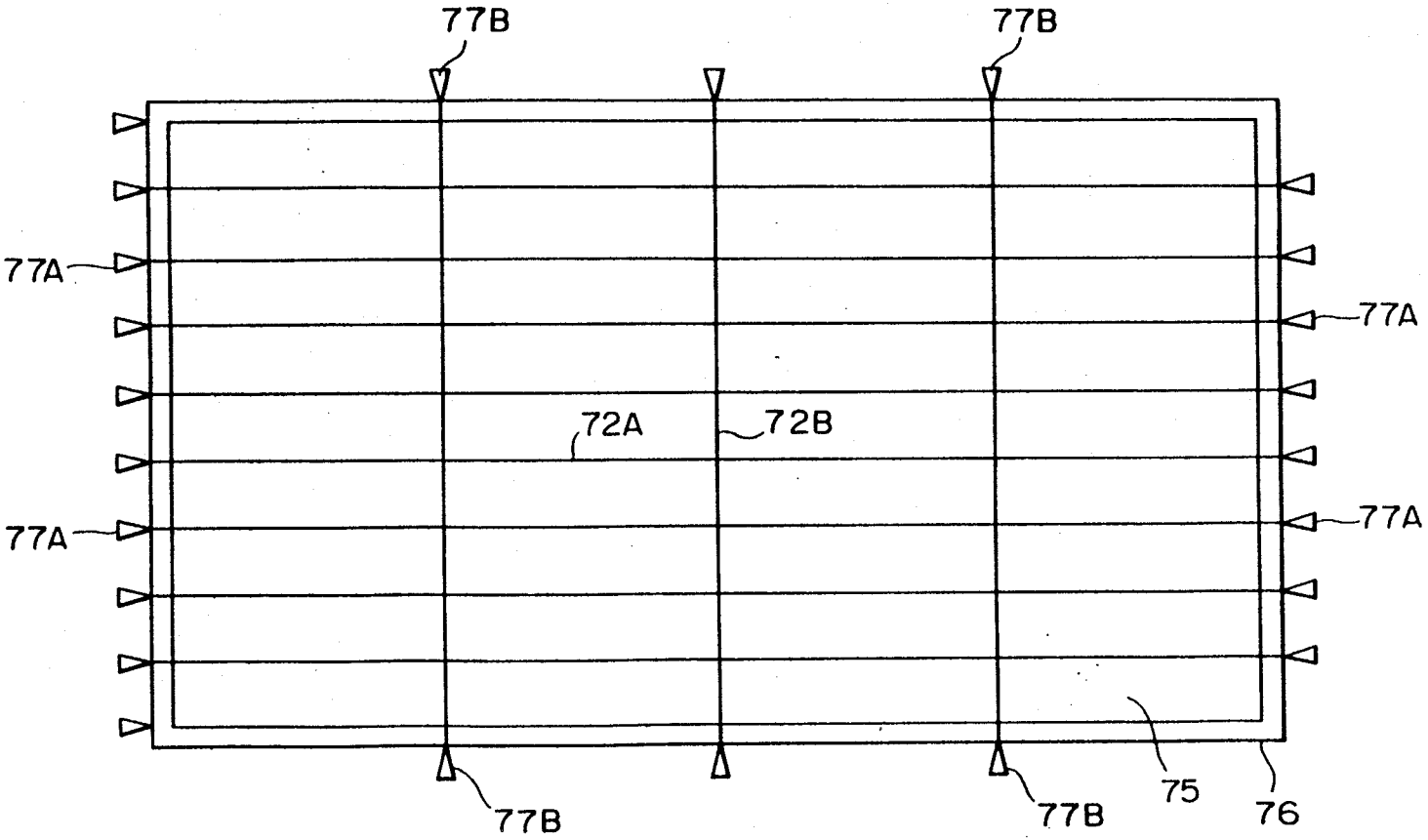
FIGS. 21 is top view of a production apparatus for the fiber grid reinforcement in FIG. 18, showing a production step of the fiber grid reinforcement.

The above-described fiber grid 36 is manufactured using a production apparatus shown in FIG. 21. The production apparatus comprises a rectangular flat surface 75 and a rectangular guide frame 76 of a uniform height disposed on the flat surface 75.

At the upper edge of the guide frame 76, first and second sets of pins are disposed which comprise a plurality of pairs of pins 77A and 77B, for hooking the fiber 72. On each of the shorter sides of the guide frame, a plurality of pins 72A of the first set are disposed so that each pair of pins 77A is disposed in a line parallel to the longer sides of the rectangular guide frame 76. The pins 77A, which may correspond to the first fiber bundle 72A, are disposed at a prescribed uniform interval of the first fiber bundle 72A. On each of the longer sides of the guide frame, a plurality of pins 72B of the second set are disposed so that each pair of pins 77B is disposed in a line parallel to the shorter sides of the rectangular guide frame 76. The pins 77B, which may correspond to the second fiber bundle 72B, are disposed at the prescribed uniform pitch of the second fiber bundle 72B.

In order to form the fiber grid 36, the fiber 72, soaked with the resin 73, is hooked to the pins 77A and 77B one after the other in the first and second directions. In the meantime, the first fiber group 72C is intermediated between a pair of the second fiber groups 72D at each of the intersecting sections 74.

Figure 22:
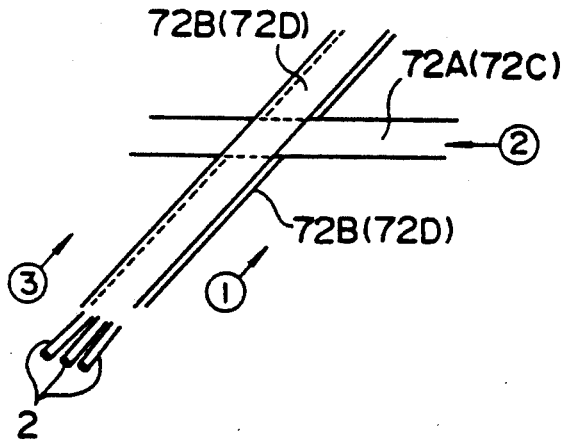
FIG. 22 is a simplified perspective view, showing a production step of the fiber grid reinforcement in FIG. 18.

In order for the first fiber group 72C to intermediate between the second fiber groups 72D, the fibers 72 soaked with the resin 73 in the groups 72D, 72C and 72D are laid out in the order (see arrows 1, 2, and 3) shown in FIG. 22.

Figure 23:
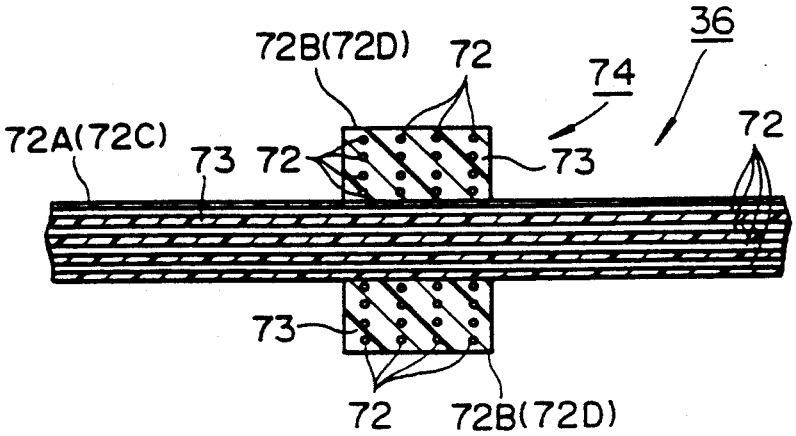
FIG. 23 is an enlarged side cross sectional view of the fiber grid reinforcement, seen in FIG. 19, before the fiber grid reinforcement is pressed to final form.
Figure 24:
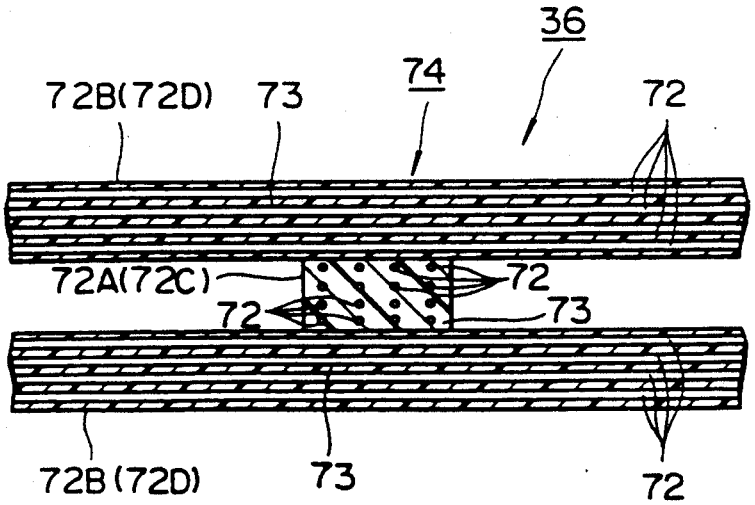
FIG. 24 is an enlarged side cross sectional view of the fiber grid reinforcement, seen in FIG. 20, before the fiber grid reinforcement is pressed to final form.

Accordingly, as clearly illustrated in FIGS. 23 and 24, the first fiber group 72C is intermediated between a pair of the second fiber groups 72D at each of the intersecting sections 74. Then, the fiber grid 36 is pressed to a final form of a uniform thickness before the resin 73 hardens as shown in FIGS. 18 through 20. The bulge at the intersecting section 74, caused by the layering of three groups 72D, 72C, and 72D, is compacted so as to have the same thickness as the other sections of the fiber grid 36.

Second Embodiment

Figure 27:
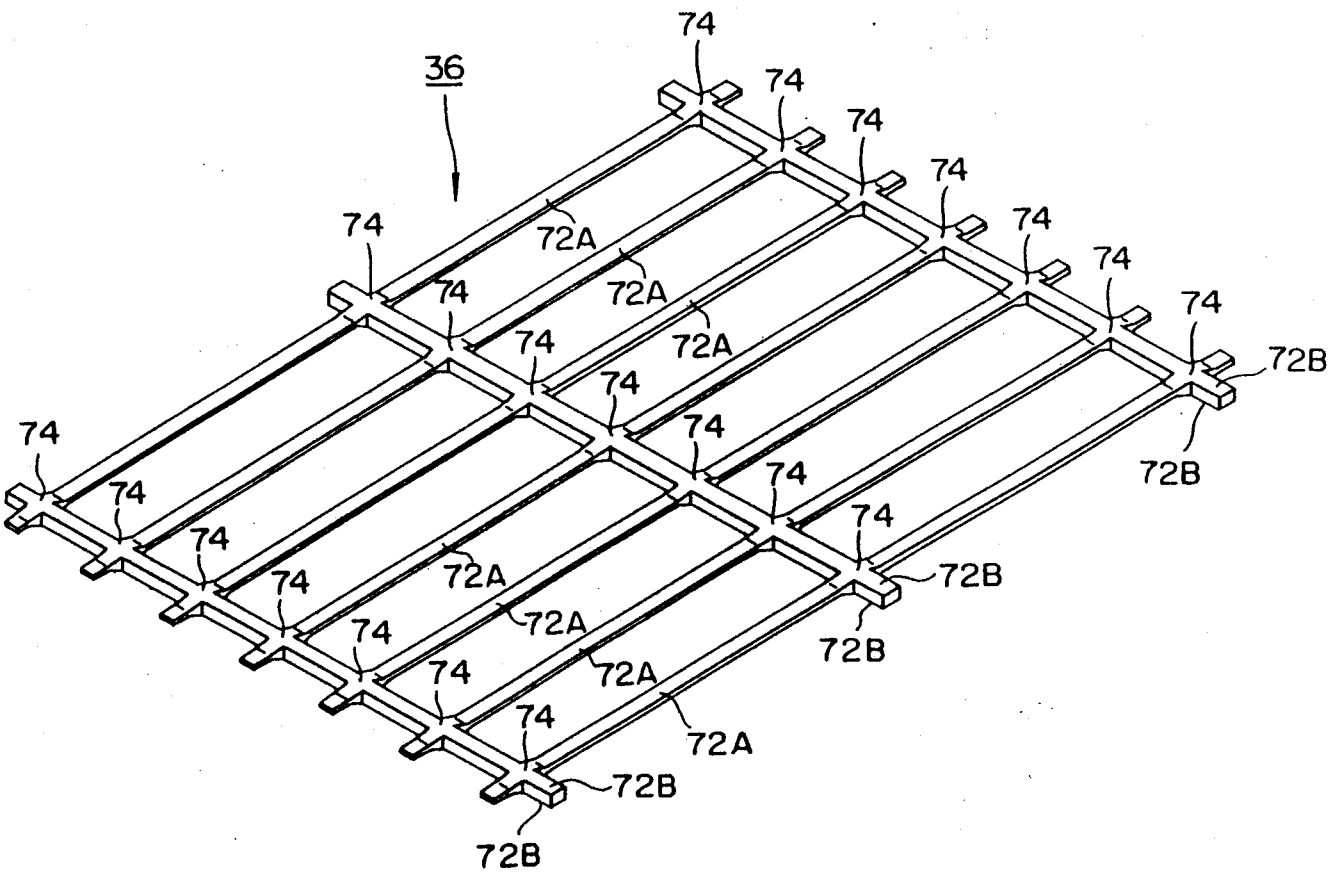
FIG. 27 is a perspective view of another variation of the fiber grid reinforcement.

FIG. 27 depicts a variation of the above fiber grid 36. In a final form of the fiber gird 36 shown in FIG. 27, the first bundles 72A have a uniform thickness; and the second bundles 72B also have a uniform thickness which is larger than that of the first bundles 72A. The intersecting sections 74 are pressed to have the same thickness as that of the second bundles 72B. Such a fiber grid structure is preferable for utilization in the above-described piled earth. That is, the thick second bundles 72B resist the force along the lengthwise direction of the first bundles 72A.

Third Embodiment

Figure 25:
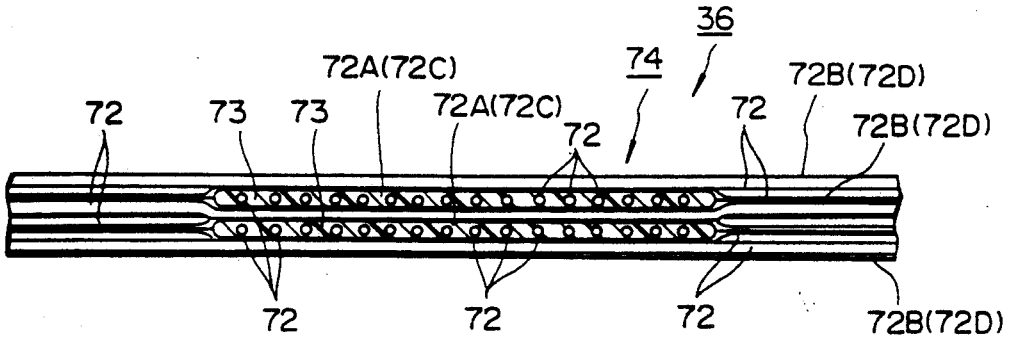
FIGS. 25 and 26 are cross sectional views of variations of the fiber grid reinforcement, both seen from the same direction as in FIG. 20.

FIG. 25 depicts another variation of the above fiber grid 36 viewed as in FIG. 20. In FIG. 25, the second fiber bundle 72B comprises three layers of the second fiber groups 72D; and the first fiber bundle 72A comprises two layers of the first fiber groups 72C interwoven with the second fiber groups 72D. The fiber groups 72C and 72D are layered alternately at the intersecting section 74.

Fourth Embodiment

Figure 26:
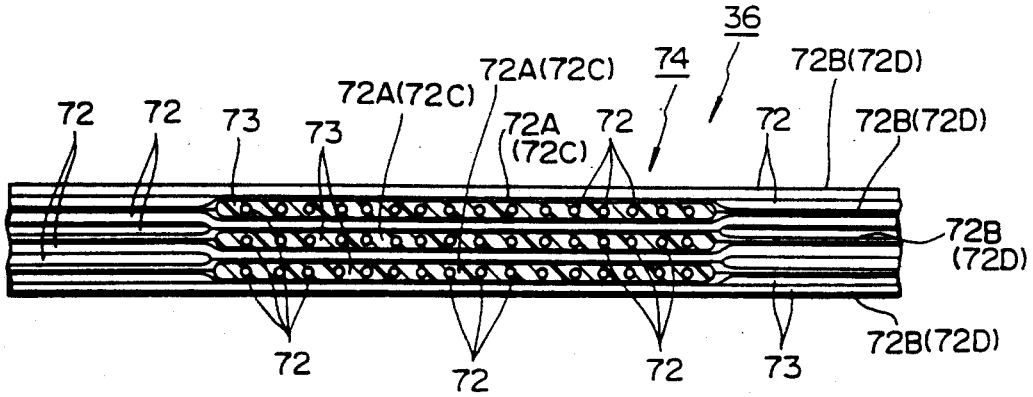

FIG. 26 depicts another variation of the above fiber grid 36 viewed as in FIG. 20. In FIG. 26, the second fiber bundle 72B comprises four layers of the second fiber groups 72D; and the first fiber bundle 72A comprises three layers of the first fiber groups 72C interwoven with the second fiber groups 72D. At the intersecting section 74, the fiber groups 72C and 72D are layered alternately.

In any event, one of the outermost layers should be the second fiber groups 72D to prevent the fiber groups 72C and 72D of the fiber grid from separating since the fiber grid 37 may be bent in a direction parallel to the first fiber grid 72A. It is more preferable that both outermost layers are the second fiber groups D.

USAGE EXAMPLES

With reference to FIGS. 1 through 17, various examples of usage of the fiber grid 36 will be described hereinafter. In the following examples, the fiber grid reinforcement is embedded in the piled earth. However, it is not intended that the usage be limited to reinforcing the piled earth. The fiber grid reinforcement can be utilized for concrete construction, the hull of a fiber-reinforced plastic boat, and the like.

FIRST EXAMPLE

FIGS. 1 through 6 depict sequential steps, respectively, in a production method for piled earth according to a first example of usage of the fiber grid reinforcement of the present invention.

Figure 6:
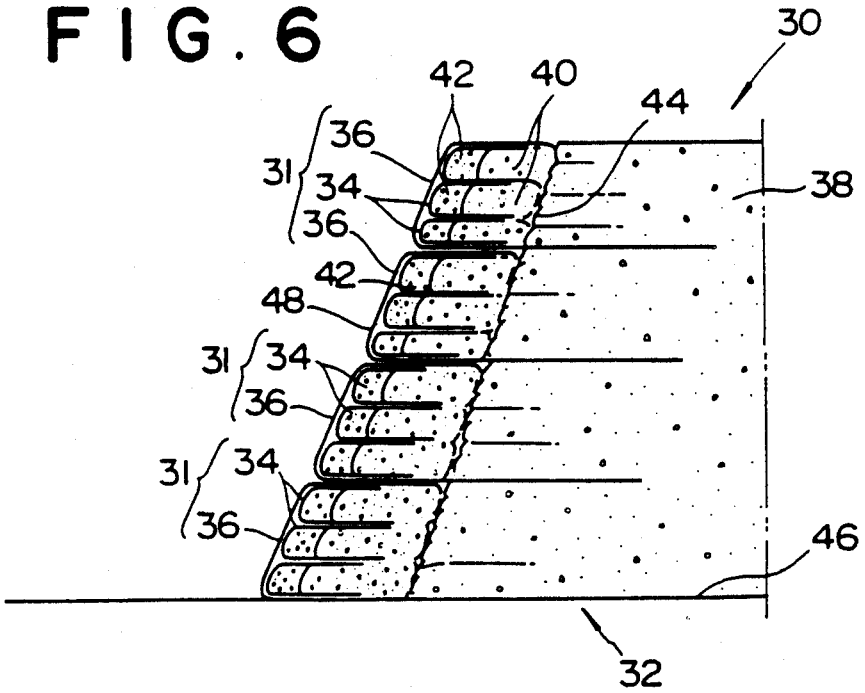

The completed piled earth 30 is illustrated in FIG. 6. The piled earth 30 is constructed on a level surface 46 of the ground. The piled earth 30 comprises soil component 32 and reinforcing means 31 made of geotextiles.

The soil component 32 has a front end face 48 inClined steeply upward in relation to the level surface 46. The soil component 32 includes four larger layers, each of which contains three smaller layers. Each of the smaller layers of the soil component 32 has a front face and upper and lower faces. The front face of each smaller layer constitutes the front end face 48 of the soil component 32. The upper face of each of the layers is substantially linked with the lower face of the layer above, so that the upper and lower faces are in part not shown.

The reinforcing means comprises four flexible outer wrapping sheets 36, made of the fiber grid reinforcement according to the present invention, which separate the front portion of the soil component 32 into the four stacked larger layers, and twelve flexible inner wrapping sheets 34 of other types of geotextile which separate the front portion of the soil component 32 into the twelve stacked smaller layers.

The term, "geotextile" used in this disclosure includes any fabric or felt which is preferable for embedding in earth for civil engineering purposes. The "geotextile" includes a geofabric, geonet (fiber net), geogrid (fiber grid, etc.), and so on.

The outer wrapping sheet 34 of the other geotextile is preferably selected from a fabric or felt, that is, a geofabric or geonet.

Each of the inner wrapping sheets 34 of geotextile includes a front part and upper and lower horizontally extending parts. The front part covers the front face of the corresponding smaller layer. The upper and lower horizontally extending parts of each inner wrapping sheet 34 extend backward horizontally respectively from the upper and lower edges of the front part thereof. Consequently, each of the inner wrapping sheets 34 wraps the corresponding smaller layer. The upper and lower horizontally extending parts are interposed between the smaller layers.

Each of the outer wrapping sheets 36 of the fiber grid reinforcement includes a front part and upper and lower horizontally extending parts. The front part covers the front face of the corresponding front parts of three inner wrapping sheets 34. The upper and lower horizontally extending parts of each outer wrapping sheet 36 extend backward horizontally respectively from the upper and lower edges of the front part thereof. Consequently, each Of the outer wrapping sheets 36 wraps the corresponding larger layer. The upper and lower horizontally extending parts are interposed between the larger layers.

Still referring to FIG. 6, the soil component 32 is shown which comprises four inclined constituent layers, each of different composition, being disposed parallel to the front end face 48 of the soil component 32. Soil-fill 38 constituted of soil and/or sand is disposed most distantly from front end face 48 of the soil component 32. A soil-hardening mixture or retaining means 40 is disposed in front of the soil-fill 38 and adjacent to the front face 48.

The term, "soil-hardening mixture" used in this disclosure is defined as a mixture of a hardener and of soil, sand, loam, or clay, mixed in suitable proportions. The hardener mixed at a suitable proportion hardens the mixture after moistening. The "soil-hardening mixture" includes soil mortar; soil cement; a mixture of fly ash and soil, etc.; a mixture of fly ash slurry and soil, etc.; a mixture of super-stiff consistency concrete and soil, etc.; soil mixed with lime; and a mixture of materials selected from the above.

The "soil mortar" is made by mixing and kneading cement, sand, loam, clay, and water. The soil mortar will hardened into a uniform body. The "soil cement" is made by mixing cement, sand, loam, and clay. The soil cement will form a porous hardened matrix. The "super-stiff consistency concrete" is a concrete with reduced cement content so that slump thereof is lessened. The super-stiff consistency concrete is usually employed for the construction of roller-compacted dams.

Plantable soil 42 is disposed in front of the soil-hardening mixture 40. Drain elements 44 such as stones and sand are disposed between the soil-fill 38 and the soil-hardening mixture 40. The front faces of the soil-fill 38, and the soil-hardening mixture 40 are generally parallel to the front face of the plantable soil 42 which can be regarded as the front end face 48 of the soil component 32.

Soil cement is used in the example as the soil-hardening mixture 40. The soil cement 40 is a mixture of cement, sand, loam, and clay, mixed in suitable proportions. In the soil cement 40, the cement component hardens the mixture after moistening.

Each inner wrapping sheet 34 of the geotextile, which is of a rectangular shape, primarily covers the front end face 48 of the soil component 32. As mentioned above, the upper and lower horizontally extending parts of each sheet of the geotextile 34 extend horizontally into the soil component 32. Both upper and lower horizontally extending parts of each sheet of the geotextile 34 end in the soil cement so that the inner wrapping sheet 36 of the fiber grid entirely contains the corresponding layer which includes the plantable soil 42, and partially contains the soil cement 40. The upper and lower horizontally extending parts of all inner wrapping sheets 34 of the geotextile end at the same distance from the front end face 48 of the soil component 32. Consequently, all the inner wrapping sheets 34 of the geotextile hold the plantable soil 40 in the above-mentioned twelve uniform smaller layers.

Each outer wrapping sheet 36 of the fiber grid, which is of a rectangular shape, also primarily covers the front face of the piled earth 30. The upper and lower horizontally extending parts of each outer wrapping sheet 36 of the fiber grid extend horizontally into the soil component 32 so as to contain every three smaller layers of the soil component 32 separated by the inner wrapping sheet 34. The outer wrapping sheets 36 of the fiber grid are longer than the inner wrapping sheets 34. The upper and lower horizontally extending parts of the outer wrapping sheet 36 of the fiber grid further extend into the soil-fill 38 so that both upper and lower horizontally extending parts of each outer wrapping sheet 36 end sufficiently far from the front end face 38 of the soil component 32. Consequently, all outer wrapping sheets 36 hold the plantable soil 42, the soil-cement 40, the drain elements 44, and even a part of the soil-fill 38 in the above-mentioned four layers.

Figure 1:
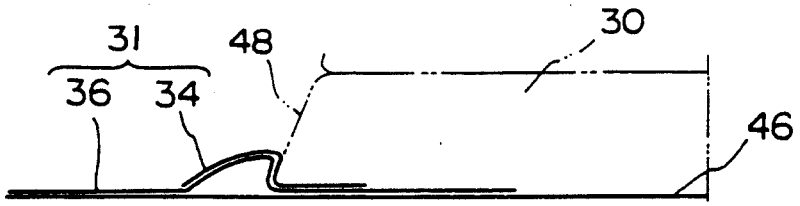
FIGS. 1 through 6 are side views showing steps in a production method for a first example of piled earth in which may be embedded a plurality of sheets of fiber grid reinforcement in accordance with the present invention.

The production method for the piled earth is as follows:

(1) First, as shown in FIG. 1, a first outer wrapping sheet 36 is placed at a prescribed location on the level surface 46. A first inner wrapping sheet 34 is placed on the center of the first outer wrapping sheet 36. The boundary of the front part and the lower horizontally extending part of the inner wrapping sheet 34 generally coincides with the boundary of the outer wrapping sheet 36.

Figure 2:
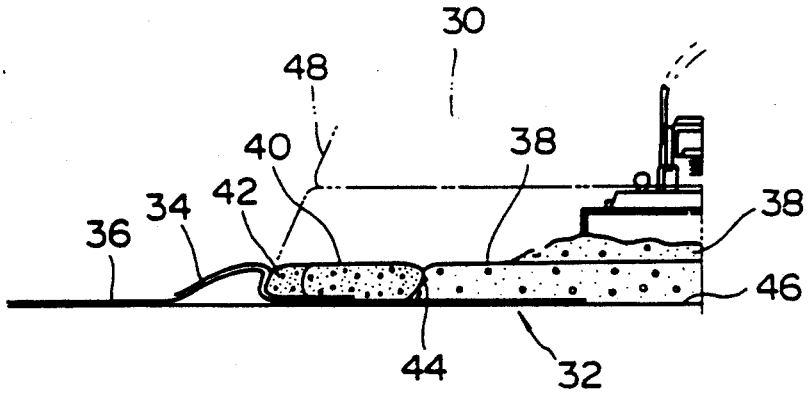

(2) Next, as shown in FIG. 2, a first layer of the soil component 32 is placed over the level surface 46. The plantable soil 42 is placed on the lower horizontally extending part of the first inner wrapping sheet 34. The soil cement 40 is placed in part on the first inner wrapping sheet 34 and in part on the lower horizontally extending part of the first outer wrapping sheet 36. The soil-fill 38 is placed in part on the first outer wrapping sheet 36 and in part on the level surface 46 in such a manner that the drain elements 44 are interposed between the soil-fill 38 and the soil cement 40.

Figure 3:
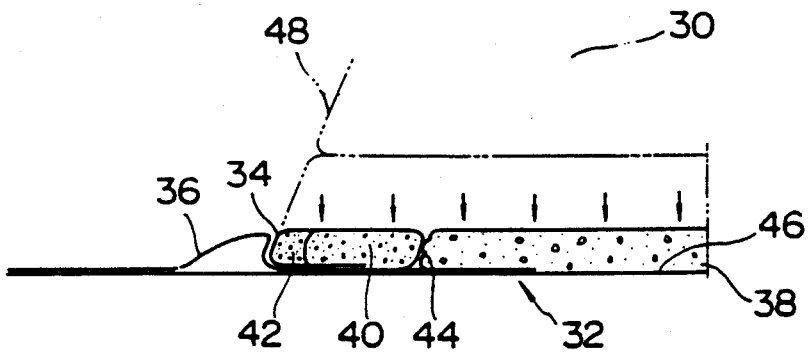

(3) Next, the first inner wrapping sheet 34 is wrapped around the front end of the plantable soil 42 in such a manner that the upper horizontally extending part of the sheet 34 reaches the soil cement 40 of the first layer as shown in FIG. 3. The entire first layer of the soil component 32 is then roll-compacted to a uniform height.

Figure 4:
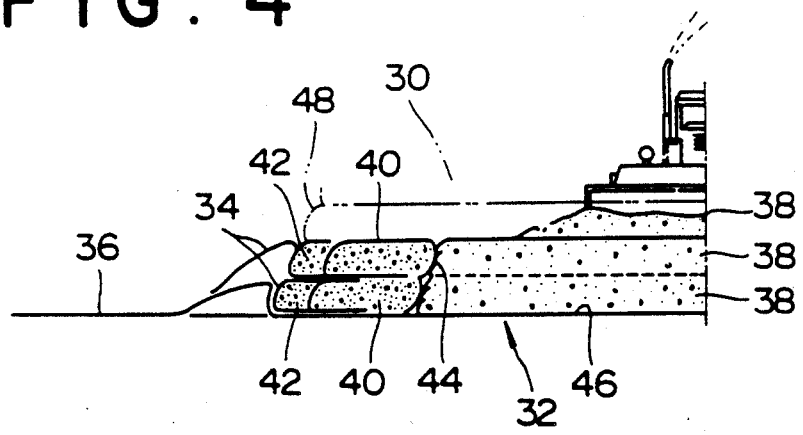

(4) Next, a second inner wrapping sheet 34 is placed on the first inner wrapping sheet 34. The lower horizontally extending part of the second sheet 34 is placed on and generally coincides with the first inner wrapping sheet 34, while the other parts of the second inner wrapping sheet 34 is disposed in front of the plantable soil 42 as shown in FIG. 4. A second layer of the soil component 32 is disposed on the first layer of the soil component 32. The plantable soil 42 and a part of the soil cement 40 are disposed on the lower horizontally extending part of the second inner wrapping sheet 34. The other constituents of the soil cement 40 are disposed directly on the previously placed soil cement 40. The soil-fill 38 is disposed on the previously placed soil fill 38. The drain elements 44 are interposed between the soil-fill 38 and the soil cement 40.

Figure 5:
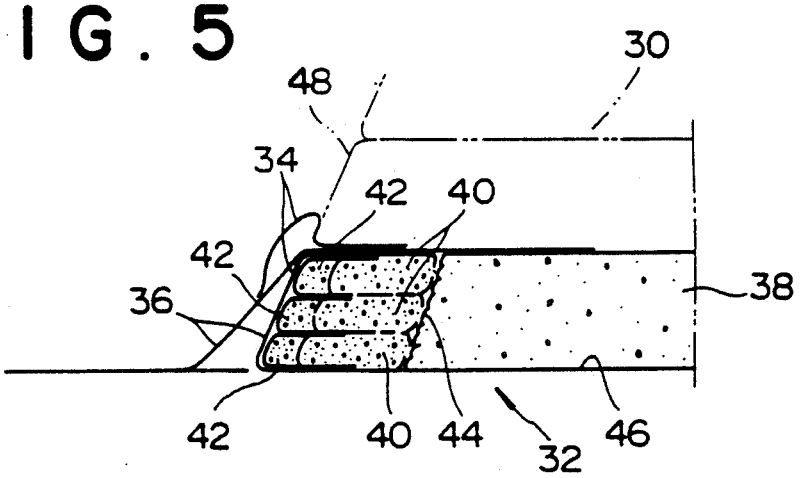

(5) The above steps (3) and (4) are repeated. Accordingly, three small layers of the soil component 32 are formed on the level surface 46 as shown in FIG. 5.

(6) The first outer wrapping sheet of the fiber grid 36 is wrapped around the front face of the three smaller layers so that the upper horizontally extending part of the first outer wrapping sheet 36 reaches the soil-fill 38 of the third smaller layer.

Figure 7:
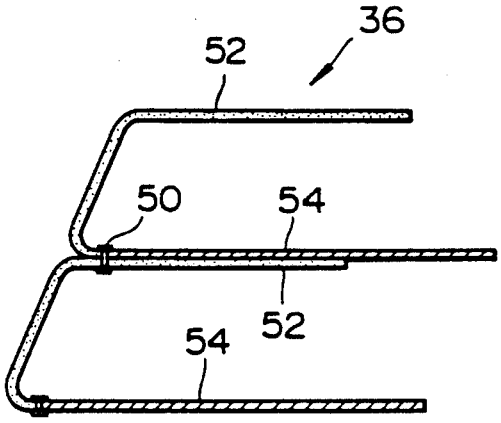
FIG. 7 is a side view of an example of usage of a fiber grid reinforcement used in the piled earth in FIG. 6.

(7) A second outer wrapping sheet 36 is placed on the first outer wrapping sheet 36. The lower horizontally extending part of the second outer wrapping sheet 36 is placed on and coincides with the upper horizontally extending part of the first outer wrapping sheet 36 while the other parts of the second outer wrapping sheet 36 are disposed in front of the front face of the first larger layer (first, second, and third smaller layers) of the soil component 32. The first and second outer wrapping sheets 36 are connected by fasteners 50 as shown in FIG. 7.

(8) The above steps (2) through (5) are repeated so that four larger layers are produced, each containing three smaller layers of the soil component 32.

As described above, the soil component 32 is piled up while each of the inner wrapping sheets 34 contains the smaller layer and each of the outer wrapping sheets 36 contains the larger layer (set of three smaller layers). Consequently, the piled earth 30 shown in FIG. 6 is produced on the level surface 46.

The outer wrapping sheet 36 of the fiber grid is composed of fibers bonded with resin so as to form a grid structure as previously described. If the fiber is primarily composed of glass fiber or aramid fiber, the sheet 36 of the fiber grid has a high mechanical strength, which is preferable for reinforcement. If the material fiber is primarily composed of polyester fiber or nylon fiber, the sheet 36 of the fiber grid has a high flexibility.

Therefore, it is preferable to manufacture the sheet 36 as shown in FIG. 7. The fiber grid 36 in FIG. 7 has a flexible part 52 and a relatively rigid part 54 of which the ends are connected to each other. The flexible part 52 is primarily composed of polyester fiber or nylon fiber, and is used for convering the front face of the soil component 32. The relatively rigid part 54 is primarily composed of glass fiber or aramid fiber, and is embedded horizontally in the soil component 32 in order to pull the soil component 32 inwards.

With such a structure, the soil-fill 38 is supported by the soil cement 40, the outer wrapping sheets 36 of the fiber grid, and the inner wrapping sheets 34 of the geotextile.

The outer wrapping sheet 36 of the fiber grid is superior in tensile strength, bending strength, shearing strength, and creep property relative to the other reinforcements which may be utilized in earth structures. Therefore, the outer wrapping sheet 36 improves the rigidity and the stability of the piled earth 30. In addition, because of the grid structure of the outer wrapping sheet 36, the soil component 32 is maintained in stable position even near the boundary of the upper and lower adjoining layers. Therefore, internal or external exerted load is dispersed evenly in the soil component 32 whereby unanticipated distortion of the piled earth 30 is effectively prevented.

Furthermore, since both upper and lower horizontally extending parts of each outer wrapping sheet 36 of the fiber grid end sufficiently far from the front end face 48 of the soil component 32, the soil component 32 is prevented from subsiding. This helps to improve the rigidity and stability of the entire piled earth 30.

The soil cement 40 resists local and total collapse of the soil-fill 38 and local load concentration. This produces further improvement in rigidity and stability of the piled earth 30.

Furthermore, since the inner wrapping sheet 34 of the geotextile is flexible, the piled earth 30 can receive suitable, uniform, evenly-distributed force resulting from the roll-compaction operation.

In addition, when internal or external force is exerted on the soil component 32, the inner wrapping sheets 34 and the outer wrapping sheets 36 pull the soil component 32 inwards (away from of the front end face 48).

As a result, the piled earth 30 is allowed to be very high (more than 10 m) and the front end face 48 of the soil component 32 is able to be formed steeply.

In this first example, the front end face 48 is produced from plantable soil 42. Thus, on the front end face 48, trees or other vegetation can be planted to improve the appearance.

If the soil cement 40 has a hardener, such as cement, mixed at a proportion low enough to allow plants to grow, seeds may be mixed into the soil cement 40. This enables vegetation to grow from the front end face 48 of the soil cement 40. In this case, the plantable soil 42 can be excluded.

With the above method, the inner wrapping sheets 34 of the geotextile are allowed to effectively wrap the plantable soil 42 and the soil cement 40; and the outer wrapping sheets 36 of the fiber grid are allowed to effectively wrap the plantable soil 42, the soil cement 40, the drain elements 44, and the soil-fill 38. Furthermore, the soil cement 40 can be hardened by means of the hardener. Therefore, the length of the construction operation can be reduced.

SECOND EXAMPLE

Figure 8:
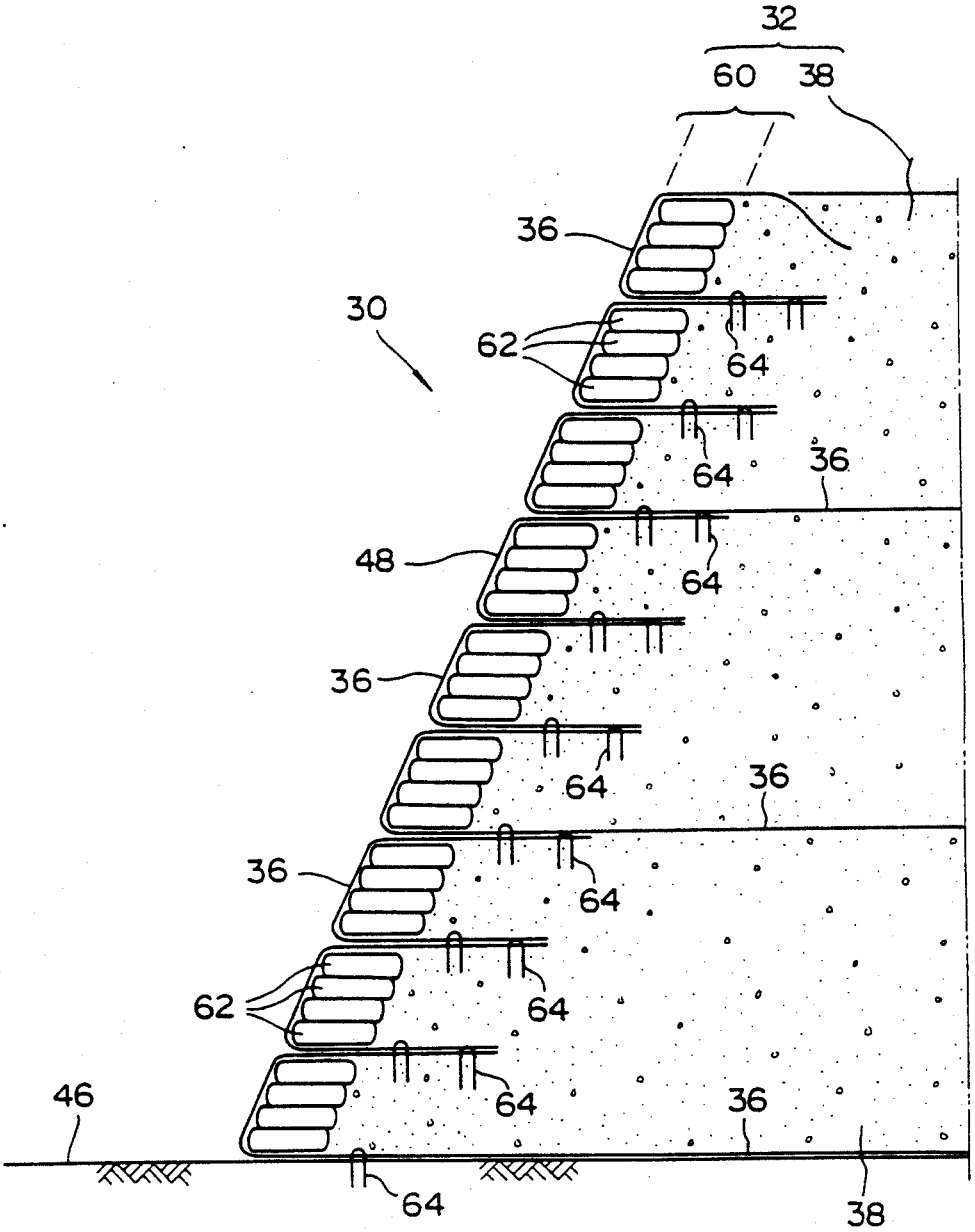
FIG. 8 is a side view of a second example of piled earth.

FIG. 8 depicts completed piled earth 30 of a second example of usage of the fiber grid reinforcement according to the present invention; and FIGS. 9 through 13 depict sequential steps of a production method therefor, respectively.

The piled earth 30 is constructed on a level surface 46 of the ground. The piled earth 30 comprises soil component 32 and reinforcing means made of geotextile.

The soil component 32 has a front end face 48 inclined steeply upward in relation to the level surface 46. The soil component 32 includes three large layers, each of which contains three smaller layers. Each of the smaller layers of the soil component 32 has a front face and upper and lower faces. The front face of each smaller layer constitutes the front end face 48 of the soil component 32. The upper face of each of the smaller layers is substantially linked with the lower face of the layer above, so that the upper and lower faces are in part not shown.

The reinforcing means comprises nine wrapping sheets 36 of flexible geotextile which separate the soil component 32 into the nine stacked smaller layers. The geotextile, in the second example, is preferably the above-described fiber grid reinforcement according to the present invention.

Each of the wrapping sheets 36 includes a front part and upper and lower horizontally extending parts. The front part covers the front face of the corresponding small layer. The upper and lower horizontally extending parts of each wrapping sheet 36 extend backward horizontally from the upper and lower edges of the front part thereof. Consequently, each of the wrapping sheets 36 wraps the corresponding smaller layer. The upper and lower horizontally extending parts are interposed between the smaller layers.

The soil component 32 comprises the soil-fill 38 and sandbags (retaining means) 36 containing soil for retaining the soil-fill 38. A front end wall 60 is constituted by sandbags 62. The sandbags 62 are piled up along the front end face 48 of the soil component 32. The soil-fill 38 is filled at the back of the front end wall 62 in such a manner that the front end face of the soil-fill 38 is generally parallel to the front end face 48 of the soil component 32.

Each rectangular wrapping sheet 36 of the fiber grid primarily covers the front end face 48 of the soil component 32. As mentioned above, the upper and lower horizontally extending parts of each wrapping sheet 36 extend horizontally into the soil component 32 so as to contain every four layered sandbags 62. Both upper and lower horizontally extending parts of each sheet of the fiber grid 36 end in the soil-fill 38. At every three smaller layers, a lower horizontally extending part of the fiber grid 36 extends farther than the other horizontally extending parts which are of generally equal lengths. Consequently, the three larger layers of the soil component 32, each including three smaller layers, are stacked one on the other.

Figure 9:
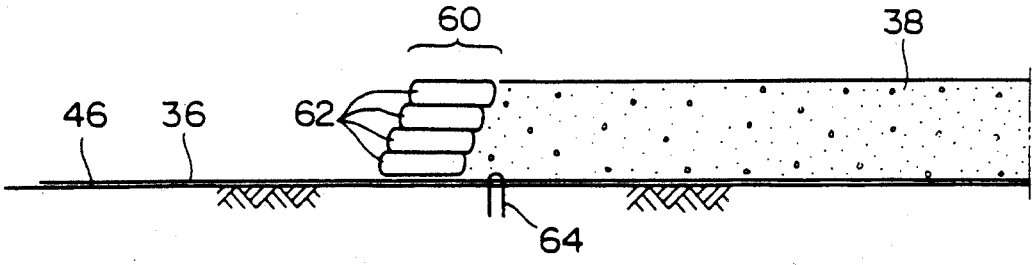
FIGS. 9 through 13 are side views showing steps in a production method of the piled earth in FIG. 8.

The production method of the piled earth is as follows:

(1) First, as shown in FIG. 9, a first wrapping sheet 36 of the fiber grid is placed at a prescribed location on the level surface 46. The lower horizontally extending part of the first wrapping sheet 36 is fastened on the level surface 46 by means of inverted L-shaped or inverted U-shaped pins 64.

Next, the first layer of the soil component 32 is placed on the level surface 46. The sandbags 62 are piled up on the horizontally extending part of the first wrapping sheet 36 so as to form the front end wall 60. Then, the soil-fill 38 is placed at the back of the front end wall 60. The other parts (the front part and the upper horizontally extending part) of the first wrapping sheet 36 are disposed in front of the front end wall 60.

Figure 10:
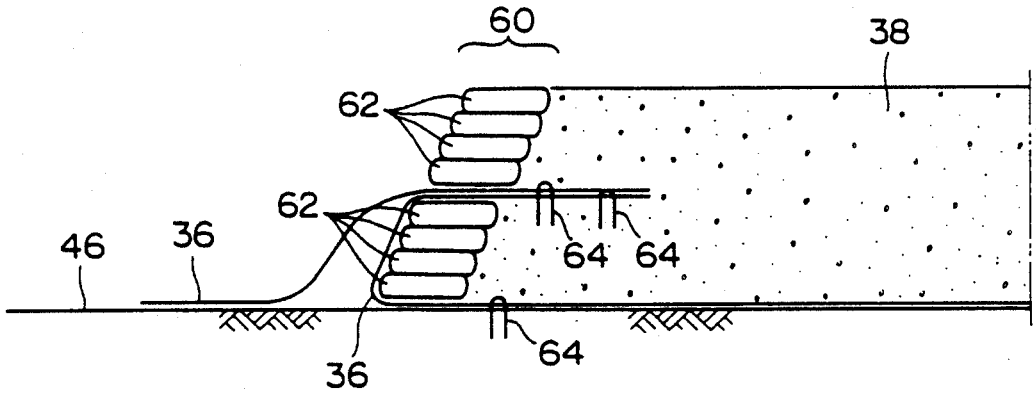

(2) Next, as shown in FIG. 10, the first wrapping sheet 36 is wrapped around the front end face of the front end wall 60 in such a manner that the upper horizontally extending part of the sheet reaches the soil-fill 38 of the first layer. The first wrapping sheet 36 is fastened to the soil-fill 38 by the pins 64. As a result, the first sheet of the fiber grid 36 contains sandbags 62 and a part of soil-fill 38 of the first layer. Then, more soil-fill 38 of the first layer is placed at the back of the previously placed soil-fill 38 of the first layer; and the entire first layer of the soil component 32, including sandbags 62 and the entire soil-fill 38, is roll-compacted to a generally uniform height. Actually, it is preferable that the soil-fill 38 be higher than the front end face 60.

The soil-fill 38 is placed using a conventional process. For example, soil-fill 38 is carried by dump-trucks to a location behind and away from the front end wall 60 so that a small hill is formed there. Then, the soil-fill 38 is carried by bulldozers, etc., towards the front end wall 60. Alternatively soil-fill from a natural hill near the construction site of the piled earth 30 can be utilized.

The roll-compact process is performed, for example, by a vibrating roller. Since the fiber grid 36 is composed of resin-coated fibers so as to form a grid structure, the fibers within the wrapping sheets 36 of the fiber grid are resist to breakage.

(3) After the above roll-compaction process for the first layer of the soil component 32 is completed, as shown in FIG. 10, a second layer of the soil component 30 is piled on the first layer. That is, the lower horizontally extending part of the second wrapping sheet 36 is placed on and coincides with the upper horizontally extending part of the first wrapping sheet 36. The other parts (the front part and the upper horizontally extending part) of the second wrapping sheet 36 are disposed in front of the previously disposed front end wall 60 of the first layer as shown in FIG. 10. Pins 64 are provided to fasten the second wrapping sheet 36 to the previously compacted soil-fill 38 of the first layer.

The second layer of the soil component 32 is disposed on the soil component 32 of the first layer. The sandbags 62 are disposed on the second wrapping sheet 36 over the front end wall 60 of the previously disposed sandbags 62. The soil-fill 38 of the second layer is disposed on the soil-fill 38 of the first layer. The upper horizontally extending part of the first wrapping sheet 36 and the lower horizontally extending part of the second sheet 36 are intermediated between the front portions of the soil-fill 38 of the first layer and the soil-fill 38 of the second layer. The second wrapping sheet 36 is shorter than the first wrapping sheet 36, so that both upper and lower horizontally extending parts of the second sheet 36 end relatively near the front end face 48 of the soil component 32 while the lower horizontally extending part of the first wrapping sheet ends very far from the front end face 48 (see FIG. 11).

Figure 11:
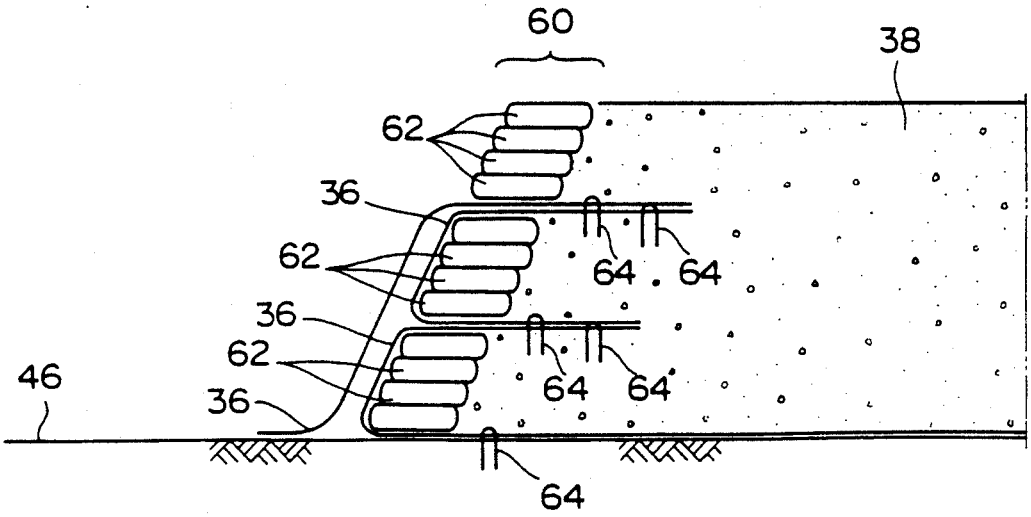
Figure 12:
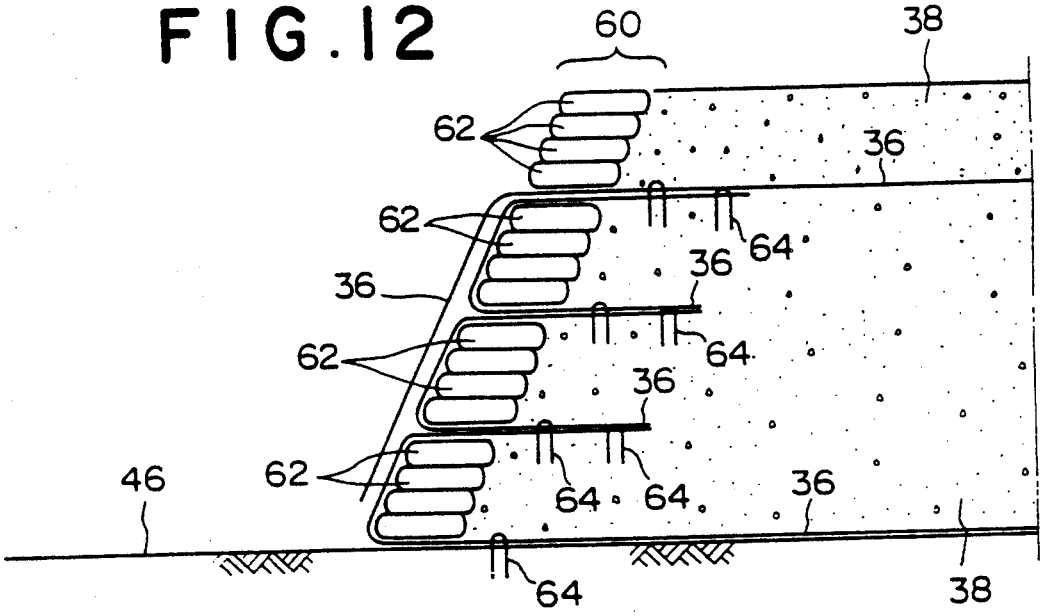
Figure 13:
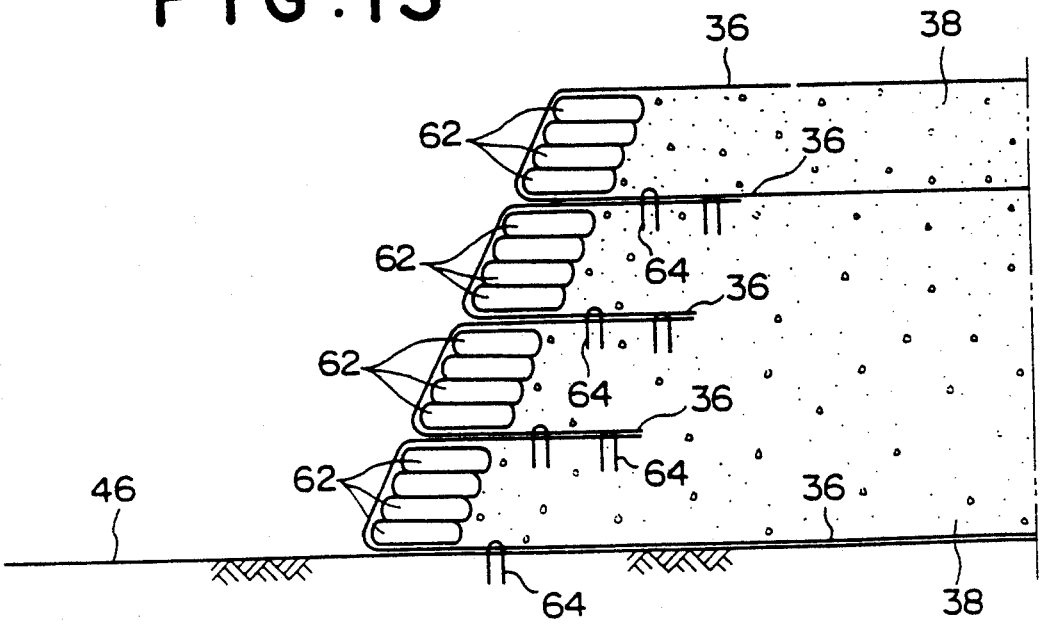

(4) The above steps (2) and (3) are repeated as shown in FIGS. 11 and 12. Accordingly, three smaller layers of the piled earth 30 are formed on the level surface 46 as shown in FIG. 12.

(5) Then, in order to form a fourth layer, the fourth wrapping sheet 36 is placed on the third layer and fastened by pins 64 as illustrated in FIG. 12. The fourth wrapping sheet 36 is of the same dimensions as the first wrapping sheet, so that the lower horizontally extending part of the fourth sheet ends very far from the front end face 48.

(6) The above steps (2) through (5) are repeated so that the three larger layers, each having the three smaller layers, are produced as shown in FIG. 8. Every three smaller layers of the soil component 32, each of the sheets (first, fourth, and seventh laid sheets) of the fiber grid 36 has a lower horizontally extending part which ends very far from the front end face 48. As described above, the soil component 32 is piled up and compacted while the wrapping sheets of the fiber grid 36 contain smaller layers of the soil component 32, respectively.

With such a structure, the soil-fill 38 is retained by the front end wall 60 of the sandbags 62, and the wrapping sheets 36 of the fiber grid.

The wrapping sheet 36 is superior in tensile strength, bending strength, shearing strength, and creep property relative to the other reinforcements which may be utilized in an earth structure. Therefore, the wrapping sheets 36 improve the rigidity and the stability of the piled earth 30. In addition, because of the grid structure of the wrapping sheets 36, the soil component 32 is linked and maintained in stable position even near the wrapping sheets 36. Therefore, internal or external exerted load is diffused evenly in the wrapping sheets 32 whereby unanticipated distortion of the piled earth 30 is effectively prevented.

Furthermore, since some lower horizontally extending parts of wrapping sheets 36 end farther from the front end face 48 of the soil component 32, the soil component 32 is prevented from subsiding. This further improves the rigidity and stability of the entire piled earth 30.

The sandbags 62 resist local and total collapse of the soil-fill 38 and local load concentration. This further improves the rigidity and stability of the piled earth 30.

In addition, when internal or external force is exerted on the soil component 32, the wrapping sheets 36 pull the soil component 32 inwards (away from the front end face 48).

As a result, the piled earth 30 has high rigidity and stability. The piled earth 30 is allowed to be very high (more than 10 m) and the front end face 48 of the soil component 32 is able to be formed steeply.

In the second example, the sandbags 62 are utilized in order to build the front end wall 60. However, blocks can be utilized instead of the sandbags 62. These blocks or sandbags 62 may be fastened one to the other when piling by nails or bolts in order to improve the stability and rigidity of the front end wall 60 and the entire structure of the piled earth 30.

THIRD EXAMPLE

Figure 14:
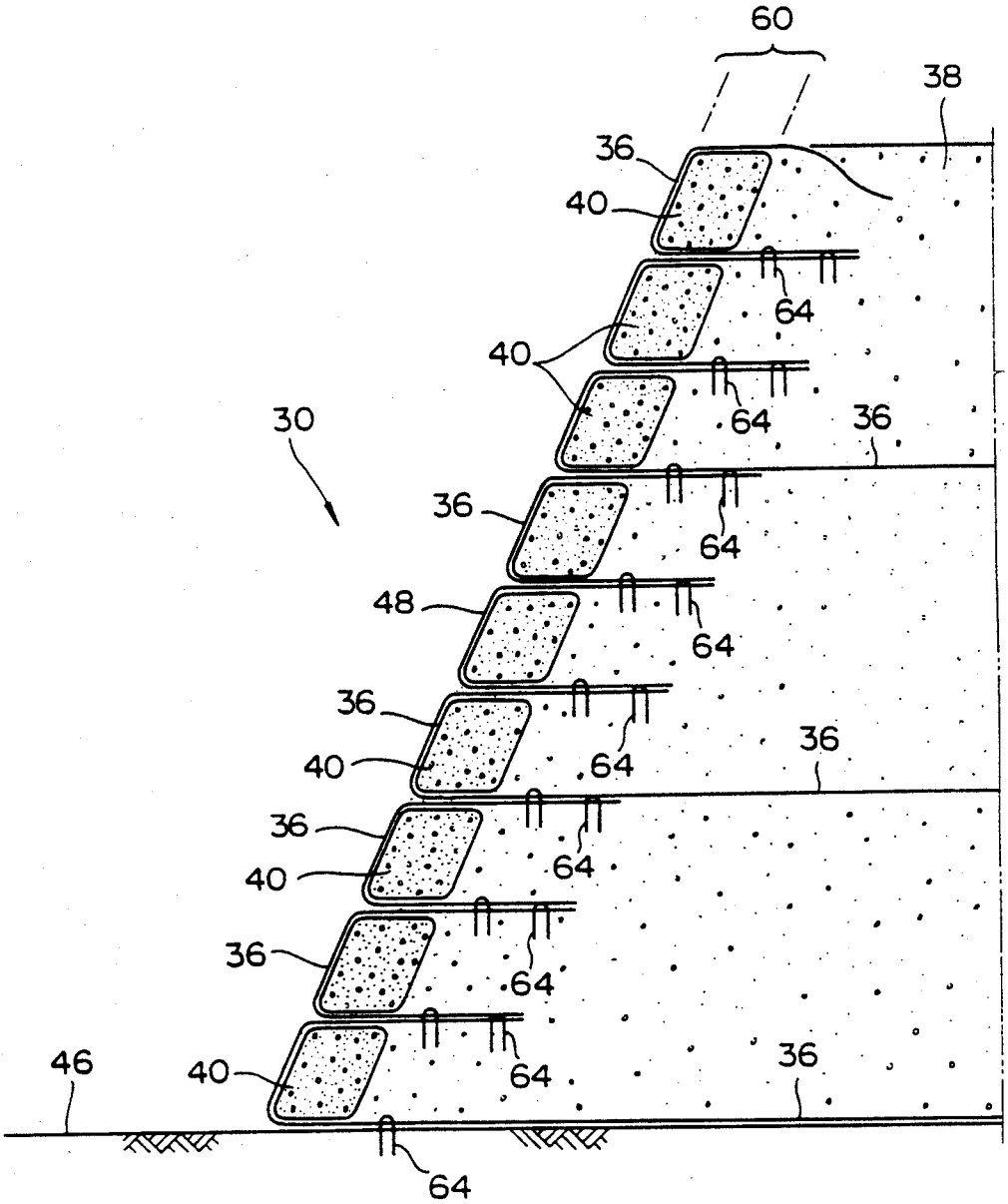
FIG. 14 is a side view of a third example of piled earth.

The piled earth 30 according to a third example of the present invention is explained with reference to FIG. 14.

In the third example, the front end wall 60 is built by the soil-hardening mixture (retaining means) 40 as a substitute for the blocks or sandbags 62 of the second example. In this example, soil mortar is used as the soil hardener 40, but the other soil-hardening mixture can also be used.

The production method of the piled earth 30 is similar to the second example. However, instead of the piling-up process of the sandbags 62, a block-forming process using the soil mortar 40 is performed. The blocks are produced one by one in courses as the layers of the soil component 32 are built up, in a manner similar to the piling-up process of the sandbags 62 of the second example. The soil component 32 of the upper layer, which includes soil mortar 40 and the soil-fill 38, is piled on the lower adjoining layer after the soil mortar 40 of the lower adjoining layer hardens. Therefore, the soil mortar 40 of each layer is substantially separated.

The third example has the same advantages as the second example. In addition, since the front end wall 60 is composed of the soil mortar 40, the unitarity and thus the durability of the front end wall 60 is improved. Therefore, the stability and rigidity of the entire piled earth 30 is improved so that the piled earth 30 is allowed to be higher than that of the second example; and the front end face 48 of the soil component 32 is able to be steeper than that of the second example.

In the third example, every three smaller layers of the piled earth 30, a sheet (first, fourth, and seventh sheets) of the fiber grid 36 has a lower horizontally extending part which ends very far from the front end face 48. Alternatively, every one or two smaller layers of the piled earth 30, a sheet of the fiber grid 36 may have a lower horizontally extending part which ends very far from the front end face 48. However, if the longer lower extending parts of the sheets of the fiber grid 36 are spaced apart at a fairly large interval, a reinforcing effect of the fiber grid in the soil-fill 38 can be obtained. Consequently, it is preferable to dispose the longer lower part of the extended sheets of the fiber grid 36 at an interval of three, four, or five smaller layers of the soil component 32 in order to reduce the number of the sheets 36 necessary and cost thereof while the horizontally extending parts of the shorter sheets 36 are placed at smaller intervals.

FOURTH EXAMPLE

Figure 15:
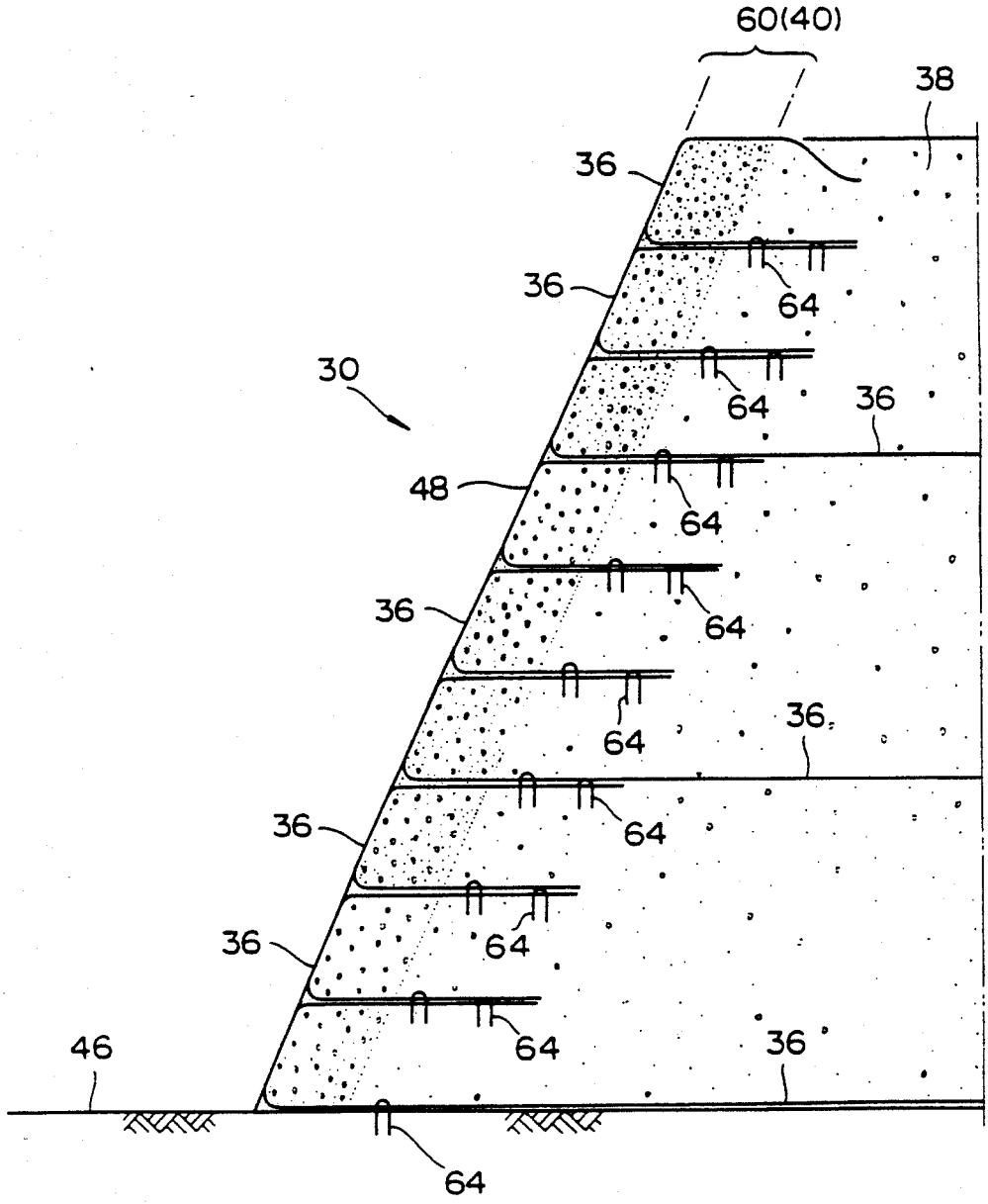
FIG. 15 is a side view of a fourth example of piled earth.
Figure 16:
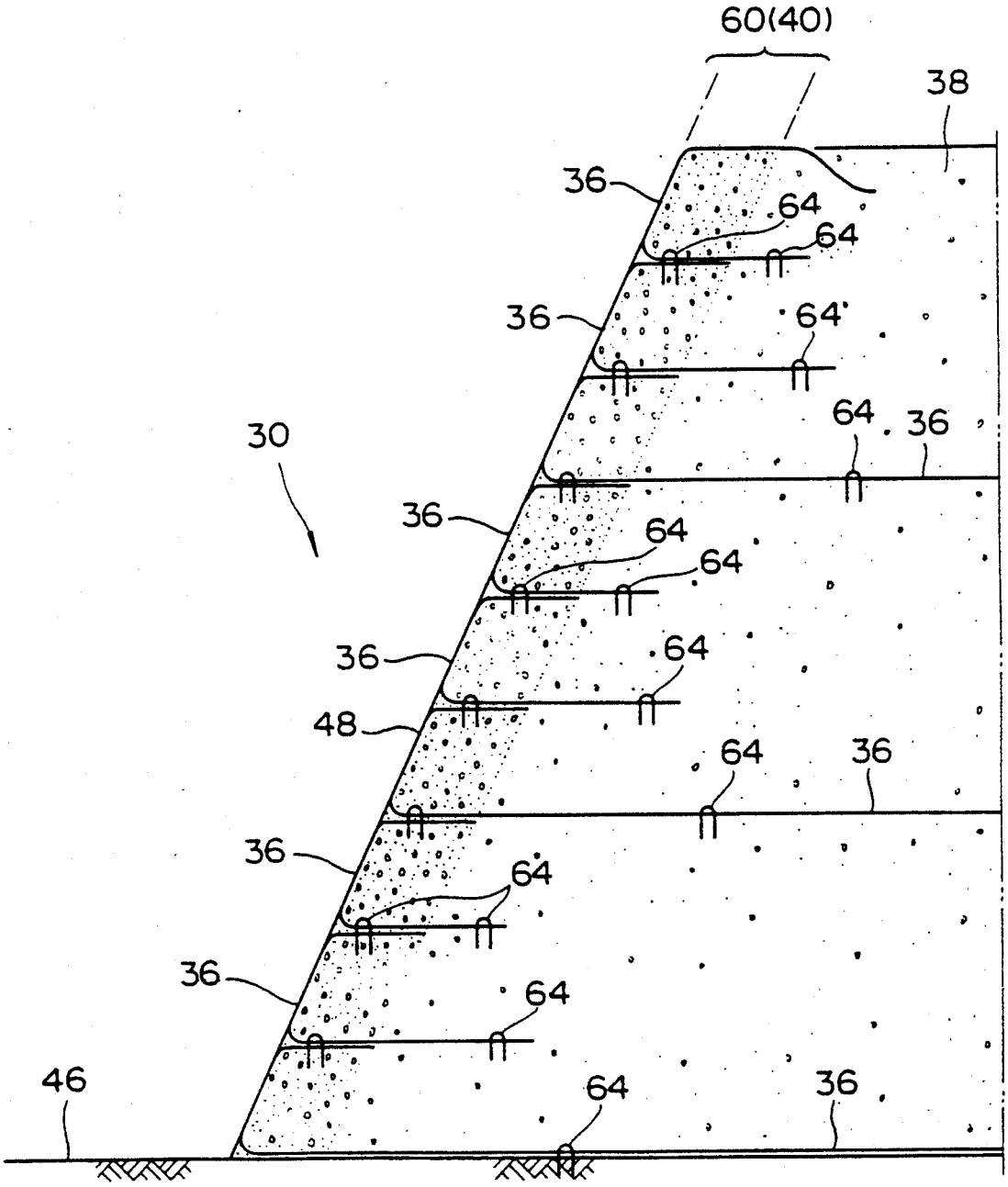
FIG. 16 is a side view of a fifth example of piled earth.

The piled earth 30, according to a fourth example of the present invention, is explained with reference to FIG. 15.

In the fourth example, the soil mortar 40 is utilized for the front end wall 60 as in the third example. However, the soil mortar 40 is not separated by the sheets of the fiber grid 36, but instead forms the united front end wall 60.

In order to form the front end wall 60 as in the method for production of the piled earth 30 in the third example, the soil mortar 40 of the upper layer is set and roll-compacted on the soil mortar 40 of the lower layer before the soil mortar 40 of the lower layer hardens completely.

In the fourth example, since the front end wall 60 is united to be rigid, the stability of the piled earth 30 is further improved.

FIFTH EXAMPLE

The piled earth 30 according to a fifth example of usage of the fiber grid reinforcement of the present invention is explained with reference to FIG. 15.

In the fifth example, the basic structure of the piled earth 30 is generally the same as in the third example. However, the wrapping sheets 36 are of different lengths. Lower horizontally extending parts of the first, fourth, and seventh sheets 36 have lengths equal to one another and end farther from the front end face 48 of the soil component 32. Lower parts of the second, fifth, and eighth sheets 36 have lengths equal to one another and are much shorter than that of the first, fourth, and seventh sheets. Lower parts of the third, sixth, and ninth sheets 36 have lengths equal to one another and are slightly shorter than that of the second, fifth, and eighth sheets. In other words, the higher the sheet is disposed, the shorter the lower part of the sheet is, in each of the larger layers.

The front end wall 60 is formed unitarily by the soil mortar 40. The wrapping sheets 36 of the fiber grid are held tightly by the soil mortar 40. Consequently, all upper horizontally extending parts of the sheets 36 can end in the soil mortar 40 and need not extend into the soil-fill 38.

The piled earth 30 of the fifth example has further advantages as follows:

If the soil-fill 38 or the ground under the level surface 46 is constituted of an undesirable soft soil such as clay or loam, local or total subsidence of the piled earth 30 is possible. If such a subsidence occurs, the longer parts of the wrapping sheets 36, which extend farther from the front end face 48, are subjected to a moving force, especially a tensile force. The stress caused by the moving force is concentrated on a section of each of the long sheets 36. This section is next to the boundary between the front end wall 60 of the soil mortar 40 and the soil-fill 38. This will likely damage or break the sheets 36. With the above structure wherein the lower sheets 36 have longer lower parts than the upper sheets 36, the stress concentration is lessened so that damage to the wrapping sheet 36 is prevented.

SIXTH EXAMPLE

Figure 17:
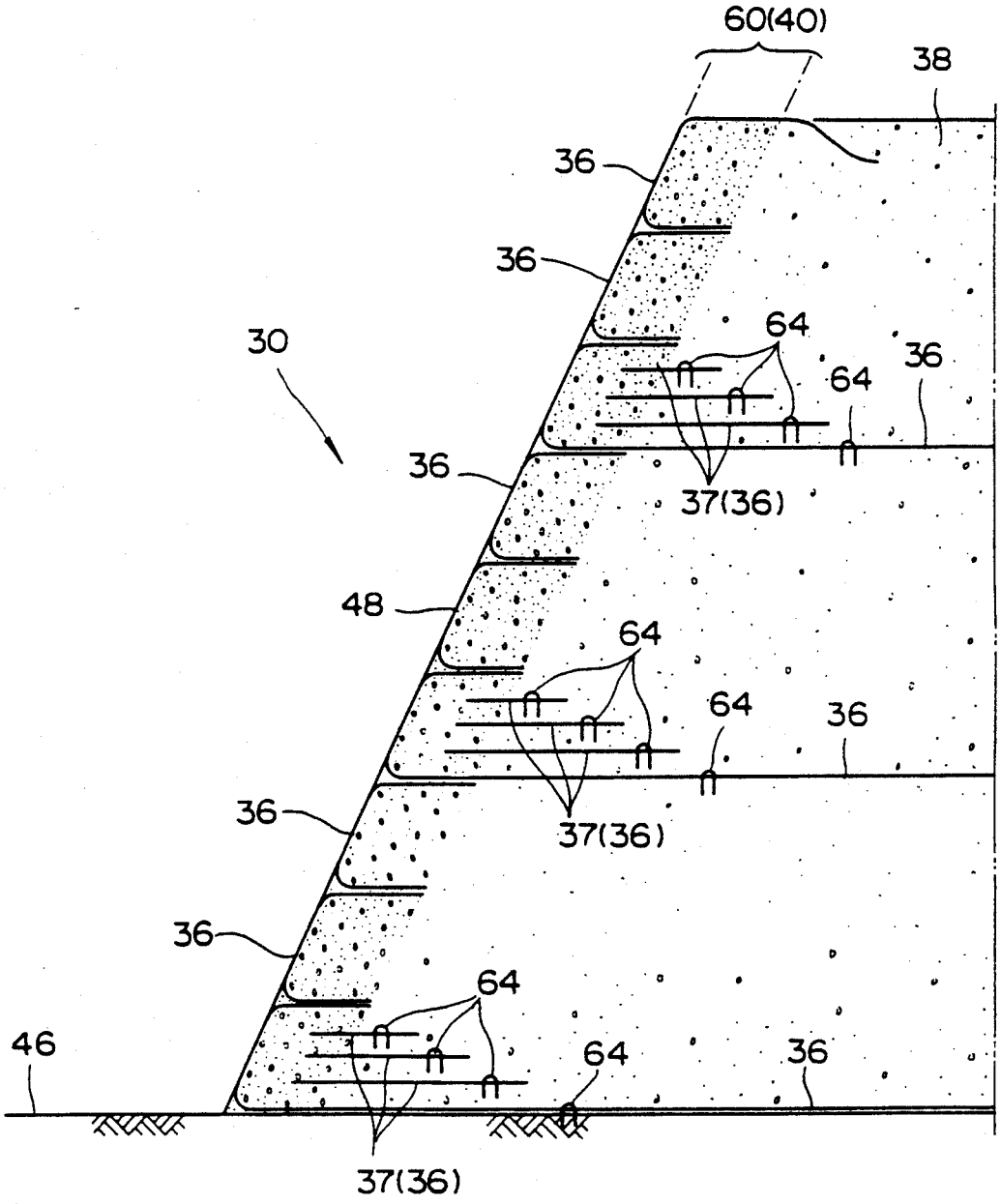
FIG. 17 is a side view of a sixth example of piled earth.

FIG. 17 depicts piled earth according to a sixth example of the usage of the fiber grid reinforcement of the present invention.

The structure shown in this figure is basically the same as that shown in FIG. 8 according to the fourth example.

However, at every larger layer, a lower horizontally extending part of the lowermost wrapping sheet 36 extends farther than the other horizontally extending parts which are of generally equal lengths.

Three linear sheets 37 of the fiber grid are embedded in each of lowermost smaller layers (first, fourth, and seventh smaller layers) at every larger layer, each of the lowermost smaller layers being supported by the longest lower extending part of the wrapping sheet 36. The sheets 37 are not wrapped around the front end face of the soil mortar 40, but are disposed horizontally crossing the soil mortar 40 and soil-fill 38. In each layer, the topmost sheet 37 is longer than the sheet 37 below it, which is longer than the bottommost sheet 37.

The linear sheets 37 of the fiber grid prevent stress-concentration on the lower extending parts of the longest wrapping sheets 36 since they pass through the soil mortar 40 and soil-fill 38 and are disposed near the longest horizontally extending parts of the wrapping sheets 36. That is, the linear fiber grid 37 results in the same advantages as the wrapping fiber grid 36 of various lengths in FIG. 16 of the fifth example, even if the soil-fill 38 or the ground under the level surface 46 is undesirably soft.

The front end wall 60 is formed unitarily by the soil mortar 40. The sheets of the fiber grid 36 are held tightly by the soil mortar 40. Consequently, all upper and lower horizontally extending parts of the wrapping sheets 36, except for the longest lower horizontally extending parts, can end in the soil mortar 40 and do not have to extend into the soil-fill 38.

In the above description, various examples of the piled earth utilizing the fiber grid reinforcement according to the present invention are described. However, various modifications or variations of the piled earth may be realized in light of the present invention.

In the second through sixth examples, plantable soil is not used. However, the plantable soil 42 may be optionally embedded between the front end face 48 (fiber grid 36) and the front end wall 60 (blocks, sandbags 62 or soil mortar 40) as in the first example in order to improve the appearance with vegetation on the front end face 48.

In addition, the above-mentioned examples can be combined as follows. For example, the front end wall 60 can be built of the blocks or the sandbags 62 plus the soil mortar 40 as a double-layered structure in which the blocks are disposed as a front inner layer and the soil mortar 40 is disposed as a rear inner layer. In this case, the blocks act as a mortar-setting form.

What is claimed is:

1. A fiber grid reinforcement of a flat shape, the fiber grid reinforcement having first and second directions perpendicular to each other, the fiber grid reinforcement comprising:

(a) a plurality of first fiber bundles generally disposed along the first direction and generally parallel to one another, each of the first fiber bundles including at least one first group of fibers;

(b) a plurality of second fiber bundles generally disposed along the second direction and generally parallel to one another, each of the second fiber bundles including at least one second group of fibers, the second fiber bundles intersecting perpendicular to the first fiber bundles at intersecting sections so as to form a grid structure, the first group and the second group of fibers being layered alternately at the intersecting sections in such a manner that at least one outermost layer is the second group; and (c) a resin material bonding fibers in each group, and bonding the groups to one another, each of the first group having a plurality of fibers, the fibers being generally arranged along the first direction, each of the second group having a plurality of fibers, the fibers being generally arranged along the second direction, each of the second fiber bundles including a greater number of fibers than each of the first fiber bundles whereby the fiber grid reinforcement having a greater flexibility in the first direction than in the second direction.

2. A fiber grid reinforcement according to claim 1, in which the second fiber bundles have a generally uniform thickness, and the intersecting sections have a thickness generally equal to that of the second fiber bundles.

3. A fiber grid reinforcement according to claim 2, in which the first fiber bundles have a generally uniform thickness, the thickness of the fiber bundles being less than that of the second fiber bundles.

4. A fiber grid reinforcement according to claim 2, in which the first fiber bundles have a generally uniform width, the second fiber bundles having a generally uniform width greater than that of the first fiber bundles.

5. A fiber grid reinforcement according to claim 4, in which the first fiber bundles are spaced at intervals from one another, and the second fiber bundles are spaced at intervals from one another, the intervals of the second fiber bundles being longer than those of the first fiber bundles.

6. A fiber grid reinforcement according to claim 1, in which each of the first group and the second group have generally the same number of the fibers, the first and second fiber groups being layered at the intersecting sections in such a manner that the outermost layers are the second fiber groups.

* * * * *